US005437971A

United States Patent [19]

Loiacono et al.

[11] Patent Number: 5,437,971

[45] Date of Patent: Aug. 1, 1995

[54] PROCESS FOR PREPARING MONODISPERSED SILVER HALIDE EMULSIONS

[75] Inventors: Marco Loiacono, Albisola Superiore; Giuseppe Loviglio, Savona, both of Italy

[73] Assignee: Minnesota Mining and Manufacturing Company, St. Paul, Minn.

[21] Appl. No.: 258,507

[22] Filed: Jun. 10, 1994

[30] Foreign Application Priority Data

Jul. 2, 1993 [EP] European Pat. Off. ..... 93110584

[51] Int. Cl.[6] ..... G03C 1/005; G03C 1/035; G03C 5/16

[52] U.S. Cl. ..... 430/569; 430/944; 430/567

[58] Field of Search ..... 430/569, 944, 567

[56] References Cited

U.S. PATENT DOCUMENTS

| | | | |
|---|---|---|---|
| 4,242,445 | 12/1980 | Saite | 430/569 |
| 4,269,927 | 5/1981 | Atwell | 430/217 |
| 4,339,532 | 7/1982 | Corben et al. | 430/567 |
| 4,619,892 | 10/1986 | Simpson et al. | 430/505 |
| 4,798,775 | 1/1989 | Yagi et al. | 430/569 |
| 4,801,523 | 1/1989 | Tufano | 430/569 |
| 4,879,208 | 11/1989 | Urabe | 430/569 |
| 5,104,786 | 4/1992 | Chronis et al. | 430/569 |
| 5,108,872 | 4/1992 | Inoue et al. | 430/944 |
| 5,178,997 | 1/1993 | Maskasky | 430/569 |
| 5,178,998 | 1/1993 | Maskasky et al. | 430/569 |

FOREIGN PATENT DOCUMENTS

| | | |
|---|---|---|
| 0165576 | 12/1985 | European Pat. Off. . |
| 0174018 | 3/1986 | European Pat. Off. . |
| 0492519A1 | 7/1992 | European Pat. Off. . |
| 1170648 | 11/1969 | United Kingdom . |

*Primary Examiner*—Charles L. Bowers, Jr.
*Assistant Examiner*—Mark F. Huff
*Attorney, Agent, or Firm*—Gary L. Griswold; Walter N. Kirn; Mark A. Litman

[57] ABSTRACT

A process for preparing a monodispersed silver halide grain emulsion characterized in that said process comprises the steps of:

(a) forming silver halide nuclei with single jet precipitation by adding a watersoluble silver salt solution to a reaction vessel containing a water-soluble halide salt solution in a hydrophilic colloid at a pCl of from 1.0 to 2.0 and at a temperature lower than 80° C., said water-soluble silver salt solution being added in an amount of from 0.1 to 15% by weight of silver relative to the total silver, (b) stabilizing said silver halide nuclei to seed crystals for at least six minutes at a temperature lower than 80° C. and at pCl of from 1.5 to 3.0 by Ostwald ripening, and (c) growing said seed crystals by double jet precipitation of silver and halide salt solutions at a constant chloride ions excess of from 30 to 70% mol and a temperature lower than 80° C.

23 Claims, No Drawings

PROCESS FOR PREPARING MONODISPERSED SILVER HALIDE EMULSIONS

FIELD OF THE INVENTION

This invention relates to a process for preparing a monodispersed silver halide emulsion. More precisely this invention relates to a process to prepare silver halide emulsions by means of a single jet nucleation and a double jet growth of the silver halide crystals in a gelatin solution. The silver halide emulsions obtained with the process of the present invention are mainly composed of silver chloride.

BACKGROUND OF THE ART

The formation of silver halide grains comprises two main steps, the nucleation step and the crystal growth step. Under some conditions of precipitation two additional processes, Ostwald ripening and recrystallization, can occur.

As disclosed in T.H. James "The Theory of the Photographic Process", 4th Edition, Macmillan Publishing Co., Inc., New York, the nucleation step is the process in which there is a population explosion of the number of crystals when entirely new crystals are created. The crystal growth step represents the addition of new layers of silver halide to crystals that are already present. Ostwald ripening occurs principally at higher temperatures, in the presence of silver halide solvents, and where there is a wide distribution of grain sizes. Under these conditions a strong tendency exists for the smaller crystals to dissolve and the large crystals to grow even larger. Recrystallization is the process in which the composition of the crystals changes. This occurs when crystals of different composition are present, because the formation of a solid solution of intermediate composition is thermodynamically favored. The recrystallization process proceeds more rapidly when silver halide solvents are present because some of the ions must dissolve and diffuse through the emulsion to form the mixed crystal phase of intermediate composition.

The silver halide grains may be precipitated by a variety of conventional techniques. The most common techniques, widely employed in the photographic industry, are the single-jet and double-jet method.

In the single jet method a silver nitrate solution is added to a reaction vessel containing a solution of halides in a protective colloid, usually gelatin. In this method, because the varying concentration of halides in the solution determines which silver halide grains are formed, the formed silver halide grains are a mixture of different kinds of shapes and sizes. This process usually creates crystals with a certain number of lattice defects, useful to improve speed, but with disuniform or wide distribution of the particle sizes.

In the double-jet method a silver salt solution in water and a halide salt solution in water are concurrently added into a reaction vessel containing the dispersing medium, usually gelatin. Double-jet precipitation processes are described, for example, in GB 1,027,146, GB 1,302,405, U.S. Pat. Nos. 3,801,326, 4,046,376, 3,790,386, 3,897,935, 4,147,551, and 4,171,224. In the double jet method the size of the formed silver halide grains can be controlled by the integration of the reaction temperature, the silver and hydrogen concentration (pAg and pH), the relative mixing uniformity of the reactants and their concentration, the precipitation flow rate, the kind and concentration of the solvent existing in the gelatin solution.

Accordingly, the preparation of a silver halide emulsion of monodispersed particles having a narrow size distribution by balanced double-jet method must be performed keeping in mind all the above mentioned variables which affect the particle sizes.

References disclosing the influence of such parameters on the average particles size and size distribution of silver halide emulsions can be found in:

(1) I.H. Leubner "Formation of Silver Halide Crystals in Double-jet Precipitation:AgCl", Journal of Imaging Science, Vol 29, June 1985, (2) R.W. Strong and J.S. Wey, "The Growth of AgCl Crystals in Gelatin Solution", Photographic Science and Engineering", Vol. 23, June 1979, (3) D.F. Shiao, "Kinetic Modelling of Growing Silver Halide Microcrystals in Gelatin Solution", "Photographic Science and Engineering", Vol. 24, May 1980, (4) I.H. Leubner "A Novel Precipitation Technique to Control the Crystal Size Distribution of Silver Halide Emulsion", Journal of Imaging Science, Vol. 34, May 1990, (5) I.H. Leubner "Nucleation in Presence of Ostwald Ripening Agents", Journal of Imaging Science, Vol. 31, April 1989, (6) I.H. Leubner "Nucleation in Presence of Growth Restrainers", Journal of Crystal Growth, Vol. 84, 1989, pp. 496–502, (7) I.H. Leubner, "Crystal Formation under Kinetically Controlled and Diffusion Controlled Growth Conditions", Journal of Physical Chemistry, Vol. 91, 1987.

According to (1) the nucleation of silver chloride crystals in double jet precipitation is function of the reactant addition rate and solubility, pAg and temperature, while the number of stable nuclei increases with increasing the addition rate and decreases with increasing solubility and temperature. References (2), (3), and (4) describe the parameters influencing the growth of silver halide grains by double jet precipitation, such as, for example, nuclei size, temperature, pCl, and redissolution of preformed grains. The effect of Ostwald ripening, promoted by silver halide solvents, and of crystal growth restrainer is also disclosed in references (5) and (6).

A process for preparing silver halide emulsions with a narrow grain size distribution is described in EP 174,018, in which the addition of monodisperse seed crystals, made by balanced double jet addition, to a gelatin alkali metal halide solution is made prior the addition of the silver nitrate solution by single jet addition. The grain size is uniform and predictable, controlled by the size, number and distribution of the seed crystals and by the total amount of silver added during the process.

U.S. Pat. No. 4,539,290 discloses a process and an apparatus for double jet precipitation in which solutions of a concentrated silver salt and halide salt are mixed in a primary mixing zone defined within the reaction vessel. The process is characterized in that the silver and halide salt solutions are alternatively introduced, with a pulse of a predetermined volume, at substantially the same point in the primary mixing zone with a predetermined pause between each pulse.

U.S. Pat. No. 4,879,208 discloses a method to prepare silver halide emulsions having a uniform silver halide composition and size distribution which comprises providing a mixer outside a reaction vessel which contains an aqueous solution of protective colloid, and in which silver halide grains are grown, feeding an aqueous solution of silver nitrate and an aqueous solution of a water soluble halide into the mixer, stirring the two solutions in the mixer to form fine grains of silver halide, and immediately introducing the fine grains into the reaction vessel. WO 90/1462 discloses a similar method wherein nucleation of silver halide grains is caused in the reaction vessel. Further improvements and modifications of the above described methods are disclosed in U.S. Pat. No. 5,104,785, EP 374,853 and U.S. Pat. No. 5,035,991. In U.S. Pat. No. 5,104,785 both the nucleation and growth of silver halide grains are performed in the reaction vessel and the formation of the fine silver halide grains is controlled by the flow rate of the solutions being supplied to the mixer and the rotational speed of the mixer. In EP 374,853 the temperature of the protective colloid solution in the mixer is kept below 40° C. and the protective colloid is gelatin having a molecular weight lower than 40,000. In U.S. Pat. No. 5,035,991 the control process further includes measuring the silver ion potential in the mixer or in the reaction vessel. In U.S. Pat. No. 5,004,679 the addition of protective colloid is performed together with the water-soluble silver or halide solution or independently.

U.S. Pat. No. 5,104,786 discloses a method for achieving uniform nucleation conditions such that the formation of younger nuclei is not influenced by the presence of older crystals. The nucleation is performed without backmixing with previously nucleated grains with a plug-flow process. The plug-flow process is carried out until to nucleation is completed and then the nucleated grains are transferred to a mixing container where they are ripened and grown. This method represents an improvement of the method described in the above mentioned U.S. Pat. No. 4,879,208, wherein a backflow in the mixer during nucleation takes place.

U.S. Pat. No. 4,339,532 describes a process to prepare a monodisperse negative working photosensitive silver halide emulsion comprising grains having a uniform habit and relatively high degree of crystal disorder by precipitating silver halide in the presence of a seed emulsion which is predominantly composed of silver chloride under conditions whereby substantially none of the silver chloride of said seed emulsion is redissolved and substantially no additional grains are formed, i.e., at a pAg of from 7 to 9.

In U.S. Pat. No. 4,242,445 a method to obtain a silver halide emulsion having a narrow grain size distribution is described. It consists in completing the nucleation of the silver halide crystals at the initial stage of grain formation and by increasing the concentrations of the aqueous solutions of the inorganic salts to such an extent that fresh nuclei are hardly produced during the period of grain growth.

EP 165,576 discloses a process for producing a monodispersed silver halide emulsion wherein in a first step polydisperse silver halide nuclei of silver halide comprising from 0 to 5 mol % of iodide are formed at pBr from −0.7 to 2.0, in a second step monodisperse silver halide seeds are formed by ripening, in the presence of a silver halide solvent, said silver halide nuclei, and in a third step the silver halide seeds are grown by addition of silver and halide salt solutions.

U.S. Pat. No. 4,269,927 discloses a high chloride silver halide emulsion comprising as a dopant at least one metal selected in the group of cadmium, lead, and zinc. Double-jet method is specifically preferred to single-jet method to obtain monodispersed silver halide emulsions.

As mentioned above, the preparation of monodispersed silver halide emulsion having a predetermined average grain size and grain size distribution by double jet method requires the control of a number of parameters. This requires expensive and complex control apparatus.

An aspect of the present invention is to provide a method for obtaining a monodispersed silver halide emulsion in which the average grain size and the grain size distribution are mainly controlled by the number of seed crystals precipitated and stabilized at an early stage of the process.

SUMMARY OF THE INVENTION

The present invention relates to a process to prepare a monodispersed silver halide grain emulsion characterized in that said process comprises the steps of:

(a) forming silver halide nuclei with single jet precipitation by adding a water-soluble silver salt solution to a reaction vessel containing a water-soluble halide salt solution in a hydrophilic colloid at a pCl of from 1.0 to 2.0 and at a temperature lower than 80° C., the water-soluble silver salt solution being added in an amount of from 0.1 to 15% by weight of silver relative to the total silver, (b) stabilizing said silver halide nuclei to seed crystals for at least six minutes at a temperature lower than 80° C. and at pCl of from 1.5 to 3.0 by Ostwald ripening, and (c) growing said seed crystals by double jet precipitation of silver and halide salt solutions at a constant chloride ions excess of from 30 to 70% mol and a temperature lower than 80° C.

DETAILED DESCRIPTION OF THE INVENTION

According to the present invention the nucleation step (a), during which the formation of silver halide nuclei takes place, is performed by single-jet method in a reaction vessel.

The reaction vessel comprises an aqueous solution of a hydrophilic colloid mixed with an aqueous solution of a water-soluble halide salt. The halide salt solution can comprise more than 50% mol relative to the total halide salts of a water-soluble chloride salt, the remaining part being comprised of bromide or iodide soluble salts. Iodide soluble salts preferably accounts for less than 1% mol relative to the total halide salts. According to a preferred embodiment of the present invention the halide salt solution comprises more than 90% mol of water-soluble chloride salt, more preferably is substantially composed of water-soluble chloride salts. The term "substantially composed of chloride salts" means that the halide salt solution comprises more than 99% of chloride salts. Preferably, the pCl of the resulting solution at the start of the precipitation ranges from 1.3 to 1.6. The pH was corrected to have a value of from 1.0 to 3.0, preferably about 2.0 to reduce the restrain activity of the hydrophilic colloid.

A silver nitrate aqueous solution is added to the reaction vessel in a period of time of from 30 seconds to 5 minutes, preferably from 30 seconds to 2 minutes. The amount of silver added in the nucleation step ranges from 0.1 to 15% mol, preferably from 0.5 to 10% mol, more preferably from 0.6 to 8% mol relative to the total silver added. During the addition of the silver nitrate aqueous solution the pCl increases. The pCl value at the end of the nucleation step ranges from 1.5 to 2.3 to have the best control of the grain size distribution.

The nucleation step ends when the formation of new nuclei of silver halide is substantially stopped. The number of silver halide nuclei is directly proportional to the amount of silver added in the nucleation step.

In the step (b) of the present invention the nuclei of silver halide obtained during the nucleation step are stabilized by Ostwald ripening for a minimum period of time of 6 minutes, preferably from 6 to 20 minutes, more preferably from 6 to 10 minutes at a constant pCl (corresponding to that of the end of nucleation). During stabilization by Ostwald ripening the grains having a grain size below their critical dimension are dissolved and the so formed silver and halide ions undergo a process of diffusion and subsequent deposition on larger crystals. The average grain size of the seeds obtained during the stabilization step is influenced by the temperature and the concentration of the halide ions of the emulsion. When the making temperature is kept below 80° C. in the presence of an excess of halide ions, a silver halide emulsion having an average grain size of from 0.05 to 0.15 μm and a dispersion index lower than 15% is obtained. The "dispersion index" is expressed by the following formula:

$$\frac{SD}{AGS} \times 100 \qquad \text{(I)}$$

wherein SD is the standard deviation and AGS is the average grain size. In particular, it has been observed that the average grain size depends on the number of silver halide nuclei formed during nucleation (i.e., on the percentage of silver used in the nucleation step) and the making temperature. For a same family of precipitated nuclei number, an increase of work temperature corresponds to an increase of average grain size and, at constant temperature, an increase of the percentage of precipitated silver during the nucleation step corresponds to a reduction of the average grain size. The average grain size of the silver halide seeds can be predetermined by modifying both the above mentioned parameters, but the average grain size distribution is not influenced by the variation of those parameters within the claimed range. Accordingly, the same average grain size and standard deviation, for example 0.45 μm and 0.05, respectively, can be obtained at different values of temperatures and percentage of silver halide nuclei, for example 50° C. and 1.25% of nucleated silver and 71° C. and 7.5% of nucleated silver.

The subsequent growing step (c) is performed by double jet method by deposition of silver and halide ions on the stabilized silver halide seeds. The double-jet precipitation is performed by adding to the reaction vessel a silver salt solution and a halide salt solution. The halide salt solution can comprise more than 50% mol relative to the total halide salts of a water-soluble chloride salt, the remaining part being comprised of bromide or iodide soluble salts. Iodide soluble salts preferably accounts for less than 1% mol relative to the total halide salts. According to a preferred embodiment of the present invention, the halide salt solution comprises more than 90% mol of water-soluble chloride salt, and more preferably is substantially composed of water-soluble chloride salts. The term "substantially composed of chloride salts" means that the halide salt solution comprises more than 99% of chloride salts. The addition of the solutions is balanced so as to maintain constant the pCl. The excess of halide ions and the temperature are kept constant in the range from 30 to 70%, preferably from 40 to 60% and from 40° to 80° C., respectively. The addition flow rate can be constant or accelerated. According to a preferred embodiment of the present invention the silver and halide addition is performed with an accelerated flow rate by a quadratic ramp starting from about 5 to 10 ml/min to about 140 to 160 ml/min.

The silver halide emulsion resulting from the process of the present invention can be a fine dispersion of silver chloride, silver chloro-bromide, and silver chloro-iodobromide in a hydrophilic colloid. Preferably, the halogen composition of the silver halide grains is an essentially silver iodide free silver chloro-bromide in which at least 50%, more preferably at least 80 mol % of all the silver halide of the grains is silver chloride. The term "essentially silver iodide free" means that the silver iodide content is lower than 1 mol %. The preferred halogen composition of the silver halide grains resulting from the process of the present invention is an essentially silver iodide and bromide free silver chloride.

As hydrophilic colloid, any hydrophilic polymer conventionally used in photography can be advantageously employed including gelatin, a gelatin derivative such as acylated gelatin, graft gelatin, etc., albumin, gum arabic, agar agar, a cellulose derivative, such as hydroxyethyl-cellulose, carboxy-methyl-cellulose, etc., a synthetic resin, such as polyvinyl alcohol, polyvinylpyrrolidone, polyacrylamide, etc.

The silver halide grains may be those having a regular crystal form, such as a cube, an octahedron, a tetradecahedron or a rhombo-dodecahedron or those having an irregular crystal form, such as a sphere or tablet, etc., or may be those having a composite crystal form. They may be composed of a mixture of grains having different crystal forms. The average grain size of the silver halide grains ranges from about 0.2 to about 2 μm, preferably from 0.3 to 1 μm. The silver halide emulsion have a narrow grain size distribution. The dispersion index obtained with the above described mathematical formula (I) is lower than 15%, preferably lower than 10%.

The emulsions can be chemically and optically sensitized as described in Research Disclosure 17643, III and IV, December 1978. In particular, the silver halide emulsions may be chemically sensitized with a sulfur sensitizer, such as allylthiocarbamide, thiourea, cystinc, etc.; an active or inert selenium sensitizer; a reducing sensitizer such as stannous salt, a polyamine, etc.; a noble metal sensitizer, such as gold sensitizer, more specifically potassium aurithiocyanate, potassium chloroaurate, etc.; or a sensitizer of a water soluble salt such as for instance of ruthenium, rhodium, iridium and the like, more specifically, ammonium chloropalladate, potassium chloroplatinate and sodium chloropalladite, etc.; each being employed either alone or in a suitable combination.

Moreover, the silver halides may be optically sensitized to a desired region of the electromagnetic spectrum. The method for spectral sensitization of the present invention is not particularly limited. For example, optical sensitization may be possible by using an optical sensitizer, including a cyanine dye, a merocyanine dye, complex cyanine and merocyanine dyes, oxonol dyes, hemioxonol dyes, styryl dyes and streptocyanine dyes, either alone or in combination. Particularly useful optical sensitizers are the dyes of the benzoxazole-, benzimidazole- and benzothiazole-carbocyanine type.

Recently, information recording equipment using semiconductor laser diodes emitting in the infrared region of the electromagnetic spectrum have been developed which require silver halide photographic elements sensitive in the same area. Examples of said equipments are the laser scanners using laser diodes which have a much longer operational life and are less expensive and smaller than conventional gas lasers such as helium-neon or argon lasers. The silver halide photographic elements for use with laser scanners using laser diodes need to be sensitized to infrared portions of the electromagnetic spectrum. The silver chloride emulsion obtained with the process of the present invention is particularly useful to prepare infrared silver halide photographic materials. Dyes which have been capable of sensitizing silver halide emulsions to infrared regions of the electromagnetic spectrum have been known for many years. Symmetrical or unsymmetrical merocyanine dyes and cyanine dyes, particularly those with longer bridging groups between cyclic moieties, have been used for many years to sensitize silver halide to the infrared, the auxochromic portions of the dyes being lepidine, quinoline, naphthothiazole, benzothiazole and the like. Heterocycles can also be introduced into the methine chain to increase stability and rigidity of the dye molecule. U.S. Pat. Nos. 3,619,154, 3,682,630, 2,895,955, 3,482,978, 3,758,461 and 2,734,900; and GB Pat. Nos. 1,192,234 and 1,188,784 disclose well-known classes of dyes which sensitize silver halide to portions of the infrared region of the electromagnetic spectrum. U.S. Pat. No. 4,362,800 discloses dyes to sensitize inorganic photoconductors to the infrared, and these dyes are also effective sensitizers for silver halide. The infrared sensitizing dyes are incorporated in the silver halide photographic emulsion in a content of $5\times10^{-6}$ mol to $5\times10^{-3}$ mol, preferably $1\times10^{-6}$ mol to $1\times10^{-3}$mol, more preferably $2\times10^{-6}$ mol to $5\times10^{-4}$ mol, per mol of silver.

It is also known that the addition of specific organic compounds to a silver halide photographic material in addition to the spectrally sensitizing dyes can increase the spectrally sensitized speed of the emulsion by more than one order of magnitude. This is known as a supersensitizing effect. As organic compounds for supersensitization of infrared sensitized silver halide emulsions which are conventionally known, there are illustrated, for example, triazine derivatives described in U.S. Pat. Nos. 2,875,058 and 3,695,888, mercapto compounds described in U.S. Pat. No. 3,457,078, thiourea compounds described in U.S. Pat. No. 3,458,318, pyrimidine derivatives described in U.S. Pat. No. 3,615,632, azaindene compounds described in U.S. Pat. No. 4,011,083, triaryl compounds described in U.S. Pat. No. 4,578,347, thiazolium and oxazolium salts described in U.S. Pat. No. 4,596,767, combinations of supersensitizers described in U.S. Pat. No. 4,603,104 and thiatriazoles described in U.S. Pat. No. 4,780,404.

The infrared sensitizing dyes can be directly dispersed in the emulsion. Alternatively, they may be first dissolved in a suitable solvent such as methyl alcohol, ethyl alcohol, methyl cellosolve, acetone, water, pyridine, or a mixture thereof to add them to the emulsion as a solution. Processes for adding the infrared sensitizing dyes to the photographic emulsion are described, for example, in U.S. Pat. Nos. 3,469,987, 3,676,147, 3,822,135, 4,199,360, and in U.S. Pat. Nos. 2,912,343, 3,342,605, 2,996,287 and 3,429,835. The aforesaid infrared sensitizing dyes may be uniformly dispersed in the silver halide emulsion before coating on a suitable support. Of course, this dispersing procedure may be conducted in any step of preparing the silver halide emulsion.

The multilayer color photographic elements of the present invention can be represented by multilayer color silver photographic elements comprising a blue sensitized silver halide emulsion layer, a green sensitized silver halide emulsion layer and a red sensitized silver halide emulsion layer. Each layer can be comprised of a single emulsion layer or of multiple emulsion sub-layers sensitive to a given region of visible spectrum. When multilayer materials contain multiple blue, green or red sub-layers, there can be in any case relatively faster and relatively slower sub-layers.

According to a preferred embodiment of the present invention, the silver halide emulsion obtained with the process of the invention can be employed in an infrared sensitive silver halide photographic elements, such as, for example, the silver halide photographic element described in U.S. Pat. No. 4,619,892, which is incorporated herein by reference. More preferably, the infrared sensitive silver halide color photographic elements for use in the present invention are those having all of the silver halide emulsion layers sensitized to different infrared regions of the electromagnetic spectrum. The order of these layers respect to the support, the difference in emulsion sensitivity among the layers and the sensitivity, contrast and D-max of each layer are preferably those described in said U.S. Pat. No. 4,619,892.

Suitable color couplers are preferably selected from the couplers having diffusion preventing groups, such as groups having a hydrophobic organic residue of about 8 to 32 carbon atoms, introduced into the coupler molecule in a non-splitting-off position. Such a residue is called a "ballast group". The ballast group is bonded to the coupler nucleus directly or through an imino, ether, carbonamido, sulfonamido, ureido, ester, imido, carbamoyl, sulfamoyl bond, etc. Examples of suitable ballasting groups are described in U.S. Pat. No. 3,892,572.

In order to disperse the couplers into the silver halide emulsion layer, conventional coupler in oil dispersion methods well-known to the skilled in the art can be employed. Said methods, described for example in U.S. Pat. Nos. 2,322,027; 2,801,170; 2,801,171 and 2,991,177, consist of dissolving the coupler in a water-immiscible high boiling organic solvent (the "oil") and then mechanically dispersing such a solution in a hydrophilic colloidal binder under the form of small droplets having average sizes in the range from 0.1 to 1, preferably from 0.15 to 0.3 $\mu$m. The preferred colloidal binder is gelatin, even if other kinds of binders can also be used.

Said non-diffusible couplers are introduced into the light-sensitive silver halide emulsion layers or into non-light-sensitive layers adjacent thereto. On exposure and color development, said couplers give a color which is complementary to the light color to which the silver halide emulsion layers are sensitive. Consequently, at least one nondiffusible cyan-image forming color coupler, generally a phenol or an a-naphthol compound, is associated with red-sensitive silver halide emulsion layers, at least one non-diffusible magenta image-forming color coupler, generally a 5-pyrazolone or a pyrazolotriazole compound, is associated with green-sensitive silver halide emulsion layers and at least one non-diffusible yellow image forming color coupler, generally a acylacetanilide compound, is associated with blue-sensitive silver halide emulsion layers.

When multilayer color materials are sensitized to infrared radiations, the yellow, magenta and cyan dye-forming color couplers are each associated with at least one silver halide emulsion layers sensitized to different regions of the infrared spectrum.

Said color couplers may be 4-equivalent and/or 2-equivalent couplers, the latter requiring a smaller amount of silver halide for color production. As is well known, 2-equivalent couplers derive from 4-equivalent couplers since, in the coupling position, they contain a substituent which is released during coupling reaction. 2-Equivalent couplers which may be used in the present invention include both those substantially colorless and those which are colored ("masked couplers"). The 2-equivalent couplers also include white couplers which do not form any dye on reaction with the color developer oxidation products. The 2-equivalent color couplers include also DIR couplers which are capable of releasing a diffusing development inhibiting compound on reaction with the color developer oxidation products.

Examples of cyan couplers which can be used in the present invention can be selected from those described in U.S. Pat. Nos. 2,369,929; 2,474,293; 3,591,383; 2,895,826; 3,458,315; 3,311,476; 3,419,390; 3,476,563 and 3,253,924; and in British patent 1,201,110.

Examples of magenta couplers which can be used in the present invention can be selected from those described in U.S. Pat. Nos. 2,600,788; 3,558,319; 3,468,666; 3,419,301; 3,311,476; 3,253,924; and in British patents 1,293,640; 1,438,459 and 1,464,361.

Examples of yellow couplers which can be used in the present invention can be selected form those described in U.S. Pat. Nos. 3,265,506, 3,278,658, 3,369,859, 3,528,322, 3,408,194, 3,415,652 and 3,235,924, in German patent applications 1,956,281, 2,162,899 and 2,213,461 and in British Patents 1,286,411, 1,040,710, 1,302,398, 1,204,680 and 1,421,123.

Colored cyan couplers which can be used in the present invention can be selected from those described in U.S. Pat. Nos. 3,934,802; 3,386,301 and 2,434,272.

Colored magenta couplers which can be used in the present invention can be selected from the colored magenta couplers described in U.S. Pat. Nos. 2,434,272; 3,476,564 and 3,476,560 and in British patent 1,464,361.

Colorless couplers which can be used in the present invention can be selected from those described in British patents 861,138; 914,145 and 1,109,963 and in U.S. Pat. No. 3,580,722.

Examples of DIR couplers or DIR coupling compounds which can be used in the present invention include those described in U.S. Pat. Nos. 3,148,062; 3,227,554; 3,617,291; in German patent applications Ser. No. 2,414,006; 2,659,417; 2,527,652; 2,703,145 and 2,626,315; in Japanese patent applications Ser. No. 30,591/75 and 82,423/77 and in British patent 1,153,587.

Examples of non-color forming DIR coupling compounds which can be used in the present invention include those described in U.S. Pat. Nos. 3,938,996; 3,632,345; 3,639,417; 3,297,445 and 3,928,041; in German patent applications Ser. No. 2,405,442; 2,523,705; 2,460,202; 2,529,350 and 2,448,063; in Japanese patent applications Ser. No. 143,538/75 and 147,716/75 and in British patents 1,423,588 and 1,542,705.

The silver halide photographic material can comprise other conventional photographic adjuvants, such as, for example, optical brighteners, antifogging agents and stabilizers, filtering and antihalo dyes, hardeners, coating aids, plasticizers and lubricants and other auxiliary substances, as for instance described in Research Disclosure 17643, V, VI, VIII, X, XI and XII, December 1978. The layers of the photographic emulsion and the layers of the photographic element con contain various colloids, alone or in combination, such as binding materials, as for instance described in Research Disclosure 17643, IX, December 1978. The colloid can be partially or totally hardened by any of the variously known photographic hardeners, such as, for example, free aldehydes (U.S. Pat. No. 3,232,764), aldehyde releasing compounds (U.S. Pat. No. 2,870,013), s-triazines and diazines (U.S. Pat. No. 3,325,287 and U.S. Pat. No. 3,992,366), aziridines (U.S. Pat. No. 3,271,175), vinylsulfones (U.S. Pat. No. 3,490,911) carbodiimides, and the like. The above described emulsions can be coated onto several support bases (cellulose triacetate, paper, resin-coated paper, polyester included) by adopting various methods, as described in Research Disclosure 17643, XV and XVII, December 1978.

The following examples are provided for further illustration of the claimed process of the present invention but should not be construed as limiting.

EXAMPLES

A. COMPARISON

The following comparison emulsions were prepared by double-jet precipitation at constant or accelerated flow rate of silver nitrate (3) and sodium chloride (2) aqueous solutions into a reaction vessel containing an aqueous solution of bone gelatin (1). The gelatin aqueous solution comprised 1.75% by weight of gelatin and showed a pH of 2.0 (obtained with nitric acid addition). The agitation was made by a mixer and, for a comparison, by a conventional rotating agitator, to verify the non-uniformity of grain growth. Precipitation time and temperature were variable.

The composition of the above solutions was:

| | | |
|---|---|---|
| Solution 1 | Gelatin | 80 g |
| | Deionized Water to make | 4,572 ml |
| | pH | 2.0 |
| Solution 2 | Sodium Chloride | 340 g |
| | Deionized Water to make | 2,320 ml |
| Solution 3 | Silver Nitrate | 680 g |
| | Deionized Water to make | 2,320 ml |

The working temperature was 71° C. for all solutions.

1A. The pAg of solution 1 was adjusted to 6.7, corresponding to a pCl of 1.6, by using solution 2. Then solutions 2 and 3 were simultaneously run into solution 1 over 40 minutes at a constant flow rate of 58 ml/min. The solution was continuously mixed by using a hollow rotary mixer. After precipitation the pH was adjusted to 5.5 and a carbamyl gelatin derivative was added to the resulting emulsion. The emulsion was desalted at pH 3.5–3.6 and washed. Finally the emulsion was redispersed with gelatin and water to an Ag content of about 13% by weight and an Ag to gelatin weight ratio of 1.66.

A monodispersed silver chloride emulsion having an average grain size of about 0.45 μm and a standard deviation of 0.065 was obtained.

2A. The procedure of example 1A was repeated except a precipitation period of 80 min at a constant flow rate of 28 ml/min.

A monodispersed silver chloride emulsion having an average grain size of about 0.55 μm and a standard deviation of 0.09 was obtained.

3A. The procedure of example 1A was repeated except an accelerated flow rate of from an initial 7 ml/min to a final 160 ml/min.

A monodispersed silver chloride emulsion having an average grain size of about 0.72 μm and a standard deviation of 0.06 was obtained.

4A. The procedure of example 3A was repeated except an accelerated flow rate of from an initial 28 ml/min to a final 118 ml/min.

A monodispersed silver chloride emulsion having an average grain size of about 0.44 μm and a standard deviation of 0.09 was obtained.

5A. The procedure of example 1A was repeated except a working temperature of 60° C.

A monodispersed silver chloride emulsion having an average grain size of about 0.37 μm and a standard deviation of 0.07 was obtained.

6A. The procedure of example 5A was repeated except a conventional stirring with a rotating agitator.

A monodispersed silver chloride emulsion having an average grain size of about 0.35 μm and a standard deviation of 0.16 was obtained.

B. INVENTION

The following emulsions of the present invention were prepared by a nucleation 5 step consisting in a single jet precipitation of a silver nitrate solution (3) into a reaction vessel comprising an aqueous solution of bone gelatin and sodium chloride (1) having a pCl value of from 1.37 to 1.64, and a crystal growth step consisting in a double-jet precipitation of a silver nitrate solution (3) and a sodium chloride solution (2) with an accelerated flow rate of from an initial 7 ml/min to a final 151.5 ml/min. Solution 1 was acidified with nitric acid to a pH value of about 2. The mixing was performed with a conventional rotating agitator.

Silver nitrate amount of the nucleation step and making temperature were variable.

The composition of the above solutions was:

| | | |
|---|---|---|
| Solution 1 | Gelatin | 80 g |
| | Sodium Chloride | 7.96 g |
| | Deionized Water to make | 4,668 ml |
| | pH | 2.0 |
| Solution 2 | Sodium Chloride | 332 g |
| | Deionized Water to make | 2,207 ml |
| Solution 3 | Silver Nitrate | 680 g |
| | Deionized Water to make | 2,292 ml |

The working temperature was 71° C. for all solutions.

1B. In the nucleation step 14.5 ml of solution 3, corresponding to 0.63% by weight of the total silver, were precipitated over 1 minute into solution 1, and stabilized during a pause of ten minutes at pCl value of 1.64.

In the growing step solutions 2 and 3 were simultaneously added into solution 1 with an accelerated flow over 40 minutes. After precipitation the pH was adjusted to 5.5 and a carbamyl gelatine derivative was added to the emulsion. The chloride excess was maintained to 45%. The emulsion was alesalted at pH 3.5–3.6 and washed. Finally the emulsion was redispersed with gelatin and water to an Ag content of about 13% by weight and an Ag to gelatin weight ratio of 1.66.

A monodispersed silver chloride emulsion having an average grain size of about 0.80 μm and a standard deviation of 0.05 was obtained.

2B. The procedure of example 1B was repeated except that the amount of solution 3 during the nucleation step was 21.5 ml, corresponding to 0.94% by weight of the total silver and the pCl value was maintained at 1.62.

A monodispersed silver chloride emulsion having an average grain size of about 0.71 μm and a standard deviation of 0.05 was obtained.

3B. The procedure of example 1B was repeated except that the amount of solution 3 during the nucleation step was 29 ml, corresponding to 1.25% by weight of the total silver and the pCl value was maintained at 1.60.

A monodispersed silver chloride emulsion having an average grain size of about 0.64 μm and a standard deviation of 0.05 was obtained.

4B. The procedure of example 1B was repeated except that the amount of solution 3 during the nucleation step was 58 ml, corresponding to 2.5% by weight of the total silver and the pCl value was maintained at 1.52.

A monodispersed silver chloride emulsion having an average grain size of about 0.54 μm and a standard deviation of 0.05 was obtained.

5B. The procedure of example 1B was repeated except that the amount of solution 3 during the nucleation step was 116 ml, corresponding to 5% by weight of the total silver and the pCl value was maintained at 1.49.

A monodispersed silver chloride emulsion having an average grain size of about 0.52 μm and a standard deviation of 0.05 was obtained.

6B. The procedure of example 1B was repeated except that the amount of solution 3 during the nucleation step was 143 ml, corresponding to 6.25% by weight of the total silver and the pCl value was maintained at 1.37.

A monodispersed silver chloride emulsion having an average grain size of about 0.46 μm and a standard deviation of 0.06 was obtained.

7B. The procedure of example 1B was repeated except that the amount of solution 3 during the nucleation step was 172 ml, corresponding to 7.5% by weight of the total silver and the pCl value was maintained at 1.60.

A monodispersed silver chloride emulsion having an average grain size of about 0.44 μm and a standard deviation of 0.06 was obtained.

8B. The procedure of example 3B was repeated except that the making temperature was 60° C.

A monodispersed silver chloride emulsion having an average grain size of about 0.57 μm and a standard deviation of 0.06 was obtained.

9B. The procedure of example 4B was repeated except that the making temperature was 60° C.

A monodispersed silver chloride emulsion having an average grain size of about 0.49 μm and a standard deviation of 0.06 was obtained.

10B. The procedure of example 6B was repeated except that the making temperature was 60° C.

A monodispersed silver chloride emulsion having an average grain size of about 0.40 μm and a standard deviation of 0.06 was obtained.

11B. The procedure of example 3B was repeated except that the making temperature was 50° C.

A monodispersed silver chloride emulsion having an average grain size of about 0.45 μm and a standard deviation of 0.06 was obtained.

12B. The procedure of example 4B was repeated except that the making temperature was 50° C. and the pCl value was maintained at 1.60.

A monodispersed silver chloride emulsion having an average grain size of about 0.38 μm and a standard deviation of 0.06 was obtained.

MICROSCOPY EVALUATION

By using a transmission type electron microscope at low temperature and a photographic magnification for observing the grain sizes of the samples, the average grain size (A.G.S.), the standard deviation (STD.DEV.) and the dispersion index (D.I.), i.e., the ratio between standard deviation and average grain size multiplied for 100, were calculated.

The following tables 1 and 2 resume the above data together with the process variables for the six comparison emulsions, and the twelve invention emulsion, respectively.

TABLE 1

| Emulsion Sample | Making Temp. °C. | Precipitation Flow Rate ml/min | Crystal Characteristics A.G.S. μm | Std.Dev. μm | D.I. % |
|---|---|---|---|---|---|
| 1A | 71 | 58 | 0.45 | 0.065 | 14 |
| 2A | 71 | 29 | 0.55 | 0.09 | 16 |
| 3A | 71 | 7–160 | 0.72 | 0.06 | 8 |
| 4A | 71 | 228–118 | 0.44 | 0.09 | 20 |
| 5A | 60 | 58 | 0.37 | 0.07 | 19 |
| 6A | 60 | 58 | 0.35 | 0.056 | 16 |

TABLE 2

| Emulsion Sample | Making Temp. °C. | Nuclei Number Ag % prec. | Crystal Characteristics A.G.S. μm | Std.Dev. μm | D.I. % | pCl |
|---|---|---|---|---|---|---|
| 1B | 71 | 0.63 | 0.80 | 0.05 | 6 | 1.64 |
| 2B | 71 | 0.94 | 0.71 | 0.05 | 7 | 1.62 |
| 3B | 71 | 1.25 | 0.64 | 0.05 | 8 | 1.60 |
| 4B | 71 | 2.5 | 0.54 | 0.05 | 9 | 1.52 |
| 5B | 71 | 5.0 | 0.52 | 0.05 | 10 | 1.41 |
| 6B | 71 | 6.25 | 0.46 | 0.06 | 13 | 1.37 |
| 7B | 71 | 7.5 | 0.44 | 0.06 | 14 | 1.60 |
| 8B | 60 | 1.25 | 0.57 | 0.05 | 9 | 1.60 |
| 9B | 60 | 2.5 | 0.49 | 0.05 | 10 | 1.53 |
| 10B | 60 | 6.25 | 0.40 | 0.05 | 12 | 1.37 |
| 11B | 50 | 1.25 | 0.45 | 0.05 | 11 | 1.60 |
| 12B | 50 | 2.5 | 0.38 | 0.05 | 13 | 1.60 |

The silver chloride emulsions of the present invention show an almost constant standard deviation irrespective of the temperature, number of nuclei and final size of the grains. The temperature and the nuclei number influence the final average grain size. In particular, higher temperature and lower nuclei number give rise to higher grain sizes.

The invention has been described in detail with particular reference to preferred embodiment thereof, but it will understood that variation and modifications can be effected within the spirit and scope of the invention.

We claim:

1. A process to prepare a monodispersed silver halide grain emulsion characterized in that said process comprises the steps of:

(a) forming silver halide nuclei with single jet precipitation by adding a water-soluble silver salt solution to a reaction vessel containing a water-soluble halide salt solution in a hydrophilic colloid at a pCl of from 1.0 to 2.0 and at a temperature lower than 80° C., said water-soluble silver salt solution being added in an amount of from 0.1 to 15% by weight of silver relative to the total silver, (b) stabilizing said silver halide nuclei to seed crystals for at least six minutes at a temperature lower than 80° C. and at pCl of from 1.5 to 3.0 by Ostwald ripening, and (c) growing said seed crystals by double jet precipitation of silver and halide salt solutions at a constant chloride ions excess of from 30 to 70% mol and a temperature lower than 80° C.

2. The process according to claim 1 characterized in that said halide solution in hydrophilic colloid comprises more than 50% mol relative to the total silver halide salts of a water-soluble chloride salt, the remaining part being comprise of bromide or iodide water-soluble salts.

3. The process according to claim 1 characterized in that said halide solution in hydrophilic colloid comprises more than 90% mol relative to the total silver halide salts of a water-soluble chloride salt, the remaining part being comprise of bromide or iodide water-soluble salts.

4. The process according to claim 1 characterized in that said halide solution in hydrophilic colloid comprises about 100% mol relative to the total silver halide salts of a water-soluble chloride salt.

5. The process according to claim 1 characterized in that said halide solution in hydrophilic colloid comprises less than 1% mol relative to the total silver halide salts of a water-soluble iodide salt.

6. The process according to claim 1 characterized in that said halide solution in hydrophilic colloid has a starting pCl value of from 1.3 to 1.6.

7. The process according to claim 1 characterized in that said halide salt solution in hydrophilic colloid has a pH value of from 1.0 to 3.0.

8. The process according to claim 1 characterized in that said silver salt solution addition is performed in a period of from 30 seconds to 5 minutes.

9. The process according to claim 1 characterized in that said silver salt solution addition is performed in a period of from 30 seconds to 2 minutes.

10. The process according to claim 1 characterized in that during the nucleation step an amount of silver of from 0.5 to 10% mol relative to the total silver is added.

11. The process according to claim 1 characterized in that during nucleation the pCl value increases to a range of from 1.5 to 2.3.

12. The process according to claim 1 characterized in that said stabilizing step ranges for a period of from 6 to 20 minutes at a pCl value of from 1.5 to 2.3.

13. The process according to claim 1 characterized in that at the end of said stabilizing step silver halide seeds having an average grain size of from 0.05 to 0.15 μm and a dispersion index lower than 15% are obtained.

14. The process according to claim 1 characterized in that said growing step is performed by balanced double-jet precipitation with an accelerated silver and halide salt solution flow rate starting at about 5 to 10 ml/min and rising to about 140 to 160 ml/min.

15. The process according to claim 1 characterized in that said constant chloride excess ranges from 40 to 60% mol.

16. The process according to claim 1 characterized in that said halide solution of growing step comprises more than 50% mol relative to the total silver halide salts of a water-soluble chloride salt, the remaining part being comprise of bromide or iodide water-soluble salts.

17. The process according to claim 1 characterized in that said halide solution of growing step comprises more than 90% mol relative to the total silver halide salts of a water-soluble chloride salt, the remaining part being comprise of bromide or iodide water-soluble salts.

18. The process according to claim 1 characterized in that said halide solution of growing step comprises about 100% mol relative to the total silver halide salts of a water-soluble chloride salt.

19. The process according to claim 1 characterized in that said halide solution of growing step comprises less than 1% mol relative to the total silver halide salts of a water-soluble iodide salt.

20. The process according to claim 1 characterized in that said monodispersed silver halide emulsion is an essentially silver iodide free silver chloro-bromide emulsion.

21. The process according to claim 1 characterized in that said monodispersed silver halide emulsion is an essentially silver iodide and bromide free silver chloride emulsion.

22. The process according to claim 1 characterized in that said monodispersed silver halide emulsion has an average silver halide grain size of from 0.3 to 1 μm and a dispersion index lower than 15%.

23. A silver halide color photographic material comprising at least one silver halide emulsion layer sensitized to the infrared portion of the electromagnetic spectrum wherein said silver halide emulsion layer comprises an essentially silver iodide and silver bromide free silver chloride emulsion obtained according to the process of claim 1 and having an average silver halide grain size of from 0.3 to 1 μm and a dispersion index lower than 15%.

* * * * *

UNITED STATES PATENT AND TRADEMARK OFFICE

CERTIFICATE OF CORRECTION

PATENT NO. : 5,437,971

DATED : August 1, 1995

INVENTOR(S) : Loiacono et al.

It is certified that error appears in the above-indentified patent and that said Letters Patent is hereby corrected as shown below:

Column 11, line 35, delete "nucleation 5 step" and insert --nucleation step--.

Column 11, line 68, delete "alesalted" and insert --desalted--.

Signed and Sealed this

Sixteenth Day of January, 1996

Bruce Lehman

*Attest:*

BRUCE LEHMAN

*Attesting Officer*

*Commissioner of Patents and Trademarks*